United States Patent [19]

Gammill

[11] 4,212,124

[45] Jul. 15, 1980

[54] FRAME FOR WALL-MOUNTABLE DISPLAYS

[76] Inventor: Paul Gammill, P.O. Box 60327, Houston, Tex. 77205

[21] Appl. No.: 1,017

[22] Filed: Jan. 4, 1979

[51] Int. Cl.[2] ..... G09F 1/12

[52] U.S. Cl. ..... 40/155; 40/10 R; 40/154

[58] Field of Search ..... 40/152, 152.1, 154, 40/155, 156, 158, 159, 10 R, 10 D; 52/511, 482, 483; 85/28

[56] References Cited

U.S. PATENT DOCUMENTS

| | | | |
|---|---|---|---|
| 2,346,769 | 4/1944 | Lichtor | 52/511 X |
| 3,037,596 | 6/1962 | Fordyce | 52/511 |
| 3,216,166 | 11/1965 | Brown | 52/511 |
| 4,122,583 | 10/1978 | Grittner et al. | 52/511 X |

*Primary Examiner*—John F. Pitrelli
*Assistant Examiner*—G. Lee Skillington
*Attorney, Agent, or Firm*—Frank S. Vaden III

[57] ABSTRACT

A frame for covering the border area of a wall-mounted display, including a plurality of nails with first heads at the driven end of the nail and second heads axially displaced from the first heads. A resilient structure for supplying directional pressure, such as tension spring wires, is located between the two heads radially extending beyond the first heads when expanded. The nails are driven through the display with the second nail heads holding or mounting the display on the wall. Each of the frame strips includes apertures in its underside which are larger than the first nail heads but smaller than the tension spring wires, permitting such frame strips to pass over the first nail heads and the tension spring wires contracting the wires in the process. These tension spring wires expand to hold the frame in place by resilient action. Further, the frame may be adjustable, wherein the frame strips have telescoping pieces, matingly conforming ends, and/or corner plates to enhance the beauty and add rigidity to the structure of the frame.

17 Claims, 6 Drawing Figures

FIG. 1
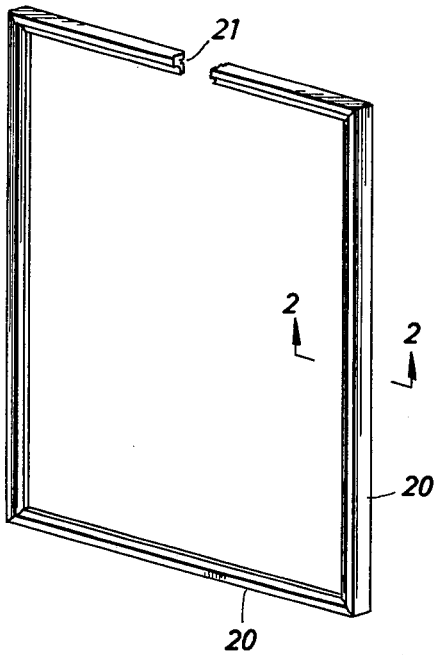
FIG. 4
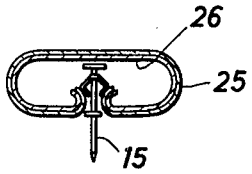
FIG. 2
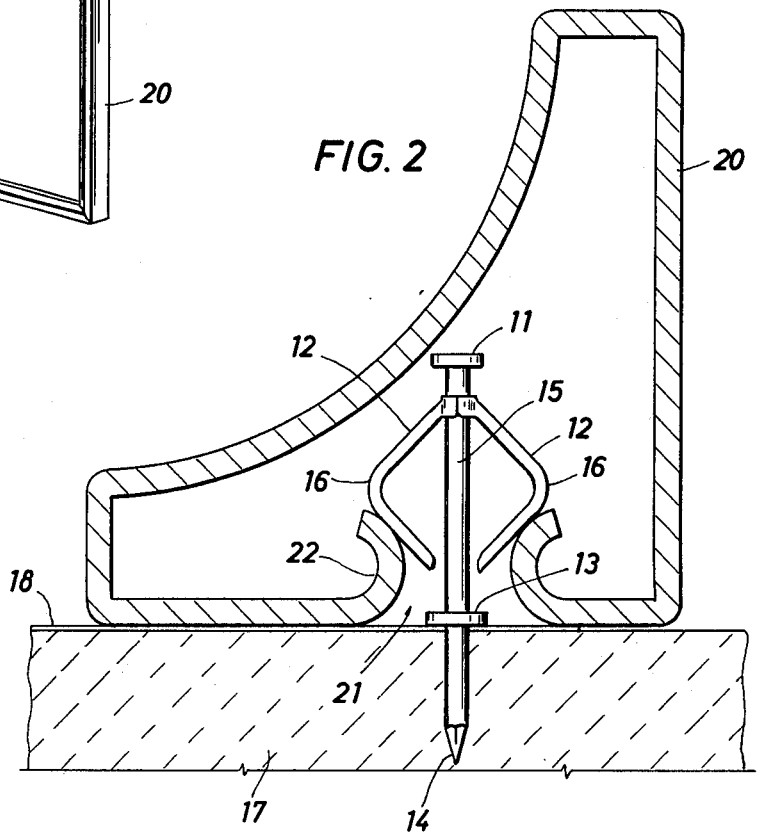
FIG. 3
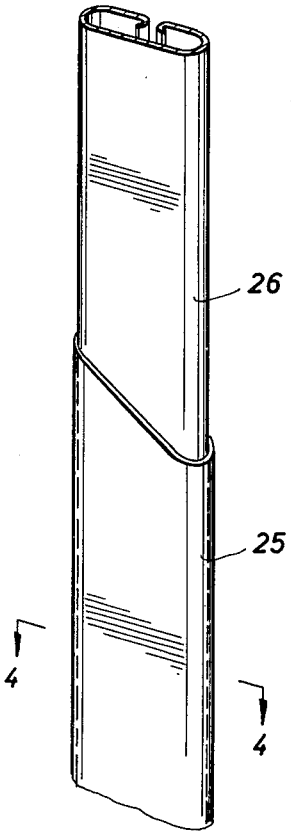
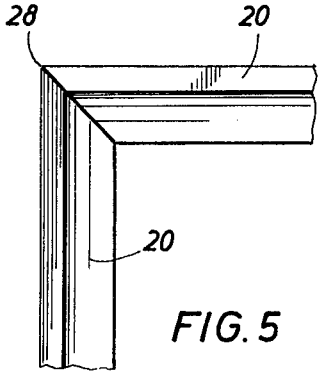
FIG. 5
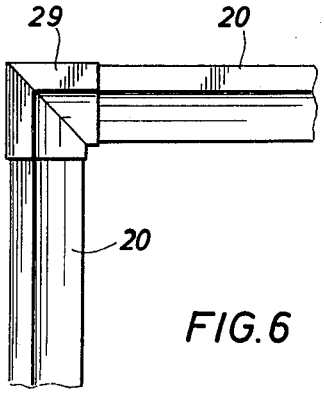
FIG. 6

FRAME FOR WALL-MOUNTABLE DISPLAYS

BACKGROUND OF THE INVENTION

1. Field of the Invention

This invention relates to a frame for covering at least a portion of the border area of a wall-mounted display, and more specifically to a frame which is easily removed, inexpensive to make, and adjustable in size, as well as capable of securing such display to the wall.

2. Description of the Prior Art

Frames have long been used to enhance the beauty of pictures, posters, charts, maps, documents, and the like, each of which is hereinafter referred to as a "display". Such frames are generally conceived as rigid non-adjustable borders that enclose the desired subject, and which may or may not have a glass facing. Frames, as well as the cost of framing the desired display, are expensive. Further, when the display is no longer desired, or needs to be changed, only displays of essentially the same size may replace the original display in the frame. This is a particular problem where display sizes may vary, such as with charts, maps and posters.

When the display is not composed of relatively rigid material, conventional frames require the display to be mounted on a somewhat rigid backing. This backing is also necessary for displays on which notations or drawings are to be made subsequent to mounting. Further, the conventional frame is not easily removed to permit access to the border areas or to change the framed subject matter, as is often desirable in the case of maps, charts, and posters.

The word "frame" as used herein with respect to the present invention is not used in its traditional sense with respect to a holding structure secured to provide a suitable border for a display whereby the display and frame form a unit apart from the wall on which the display is mounted. The "frame" described herein does provide a border for the display, but, as hereinafter disclosed, the display is secured to the wall by a plurality of special nails and the "frame" is then secured to the exposed head portions of these nails. Hence, the wall, display and frame form a unitary structure, but the frame and display above, apart from the wall, do not form such a structure.

Therefore, it is a feature of this invention to provide an improved inexpensive, easily removable and reusable "frame" for enhancing the beauty of wall-mounted displays.

It is another feature of the invention to provide an improved frame capable of securing the display being framed to the display surface such as a wall or door.

It is still another feature of this invention to provide such an improved frame that is adjustable in size.

It is yet another feature of this invention to provide such an improved frame that enhances the beauty of the display while still permitting easy access to such display.

SUMMARY OF THE INVENTION

The invention embodiments disclosed herein include a plurality of nails having two heads, wherein the first head is on the driven end of the nail and the second head is axially displaced from the first head between the first head and the point of the nail. By driving a plurality of nails through a display capable of being wall-mounted, the second heads of the nails secure the display on the wall. Means for supplying resilient downward pressure, such as tension spring wires, are attached to each of the nails proximate to the first nail head and extend radially beyond the first nail head. Frame strips which together form a border around the display are snapped over the first nail heads and tension spring wires. The wires first contract and then expand to their original size as the frame is snapped into place thereover. A frame strip may assume any desirable decorative outer section and includes at least one aperture or slot on its underside facing the display, such slot or aperture being wide enough to permit the frame strip to pass over the first nail heads. The tension spring wires provide resilient pressure on the lips of the frame strip surrounding the slot or aperture maintaining the frame against the display and wall.

The slot or aperture can be curved backwardly and inwardly to form lips for enhancing the resilient pressure. Each of the frame strips can be made adjustable by constructing them with telescoping pieces that adjust by pushing or pulling the inner piece within the outer piece. A corner clip can be added at the corner joints of the fram strips to enhance the beauty of the frame as well as provide increased rigidity to the frame.

BRIEF DESCRIPTION OF THE DRAWINGS

So that the manner in which the above-recited features, advantages and objects of the invention, as well as others which will become apparent, are attained and can be understood in detail, more particular description of the invention briefly summarized above may be had by reference to the embodiments thereof which are illustrated in the appended drawings, which drawings form a part of this specification. It is to be noted, however, that the appended drawings illustrate only typical enbodiments of the invention and are therefore not to be considered limiting of its scope, for the invention may admit to other equally effective embodiments.

In the drawings:

FIG. 1 is a pictorial illustration of a preferred embodiment of the invention disclosed herein.

FIG. 2 is a cross-sectional view taken along line 2—2 of FIG. 1 attaching a typical display to a wall, also shown in cross section.

FIG. 3 is a pictorial illustration of an alternate preferred embodiment of the invention disclosed herein illustrating an adjustable frame having a concavedly curvilinear construction.

FIG. 4 is a cross-sectional view taken along line 4—4 of FIG. 3.

FIG. 5 is an enlarged pictorial illustration of a corner of the frame illustrated in FIG. 1 including 45° mitered corners.

FIG. 6 is a pictorial illustration of another preferred embodiment of the invention described herein illustrating a corner plate for enhancing the beauty and adding rigidity to the structure of the frame.

DESCRIPTION OF THE PREFERRED EMBODIMENTS

Now referring to the drawings and first to FIG. 1, a frame in accordance with the present invention, excepting a small section which has been removed for illustration purposes, is shown. Four frame strips 20 whose aesthetic qualities may be varied as the marketplace dictates, have a plurality of apertures or preferably a slot 21 running through the wall-facing side of the frame. A slot type of aperture normally exhibits ease in manufacture and material savings. A frame strip can be conveniently made, for example, of metal or wood and can be molded or extruded of plastic. A slot is more desirable than a plurality of apertures, not only because of possible advantages relating to manufacture, but also in its intended use. A slot provides an indefinite range of positioning during mounting, and therefore such a slotted frame strip is a more universal component than a frame strip having a plurality of separate apertures that could only be mounted at a finite number of positions.

FIG. 2 illustrates a cross-sectional view of a frame strip 20 taken along the line 2—2 of FIG. 1, and shows a point chosen for fastening the frame strip in place. Nail 15, preferably made of a strong material such as steel to thwart abuse and permit reuse, and having first head 11 on the driven end of the nail, has a second head 13 axially displaced from the first head. Such nail is driven either above or through a wall-mountable display 18 into wall 17, the latter method securing or assisting securement of display 18 in place, especially when nail 15 is driven sufficiently deep that the second nail head presses the display to the wall. Slot 21 runs lengthwise with regard to each frame strip 20 and is large enough to pass over the first nail head 11 and is deep enough to permit the frame to continue toward the point of nail 14 until proximate to or touching the plane of display 18 and wall 17.

Frame strips 20 are held in place by downward and outward pressure on frame lips 22 originating from the area between the two nail heads. This pressure may be supplied by tension spring wires 12 attached to the nail to or below the first nail head and extending away therefrom toward nail point 14. These tension spring wires are preferably pieces of somewhat flexible metal or plastic that when attached, bow outwardly from the stem of the nail. The inherent tension on tension spring wires 12 must be sufficient to extend the bowed area radially outward beyond the edge of the first nail head. When frame strips 20 are pushed over nails 15 toward display 18 and wall 17, frame lips 22 push the tension spring wires causing downward elongation and contraction in lateral size. As the frame strip approaches the display and wall, the upper inside edge of the lips passes the point of maximum angle of bow 16 permitting the extended tension spring wires 12 to resile. Equivalent resilient means can be used if desired. The bottom portion of the tension spring wires create a downward and outward pressure on frame lips 22 pressing the frame strip toward display 18 and wall 17, and holding the frame strip in place.

Preferably four tension spring wires are used around the periphery of the nail so that alignment with the slot is not so critical. Preferably, tension spring wires 12 protrude outwardly only sufficiently far past frame lips 22 so as to be capable of providing resilient pressure on the frame. That is, the bow of the spring wires should not be so great so as to cause damage to the wires when the frame strip is snapped off the nail heads. The frame can thus be easily removed by pulling outwardly thereon, with the tension spring wires again being elongated rather than pushed backward incurring a folding action and damage.

Minor adjustments are also possible after mounting. Moreover, the nails may be extracted and used again. Extraction is particularly easy with little damage incurred, when nails 15 are manufactured such that tension spring wires 12 are attached sufficiently below first nail head 11 so as to permit a nail removing device to be inserted therein for removal of the nail. Extra nails may be included in packaging to allow for breakage and mounting of particularly large or difficult pictures.

Frame strips 20 do not support any additional weight such as the display, glass, or backing, permitting a very lightweight material to be used in constructing such frame. If the material used in constructing the frame lips is very thin it will be difficult to construct a tension spring wire that will provide sufficient pressure on the edge of such thin frame lips. When the material used in constructing the frame lips is thin, curved frame lips 22 are preferably used facilitating distribution of the resilient pressure provided by tension spring wires 12, increasing the area where pressure can be applied to the frame lips, and reducing the precision required in aligning slot 21 with nail 10.

It is also possible to use a frame that is hollow. However, since there is certain amount of pressure that must be applied to the frame to push it over nail 10 and tension spring wires 12, there is a clear danger that frames of lightweight collapsible material will not withstand the applied pressure and may be crushed. Additional internal structural support for a hollow frame 20 may be provided by one or more internal extrusion beams (not shown) so placed, depending on the structure, as to reinforce the stability of the outer surface.

FIG. 3 illustrates another embodiment of the invention wherein the frame strip is adjustable. Each strip or segment of frame consists of two or more telescoping pieces. Exemplary of these telescoping pieces in an outer section 25 of the frame and an inner section 26 of the frame having frictional cohesion to each other. The length of each frame strip is adjusted by pushing or pulling inner section 26 within outer section 25. When a display is removed and a new display of different size is exchanged therefor, the adjustable frame is adjusted to accommodate this new size of display. Previously, it has been necessary to acquire a second frame of the particular size required for the new different sized display.

A particularly useful design for adjustable frame segments is concavedly curvilinear. This shape is easy to produce, permits easy interchange of parts, is structurally strong, and permits easy telscoping of the separate pieces.

FIG. 4 is a cross-sectional view of FIG. 3 taken along line 4—4 at a point where inner section 26 is within outer section 25. This illustration shows the telescoping parts and nature of adjustable frame strips.

FIG. 5 is an enlargement of the corner made by two frame strips 20, illustrating that each frame strip has 45° mitered joint corners.

To save storage space, packaging materials and costs, distribution costs and the like, the frame is preferably made and packaged in strips. Corners that are mitered at a 45° angle are aesthetically pleasing and can be easily capped with corner clips 29 as illustrated in FIG. 6. A useful corner clip 29 as described herein is compression molded or stamped, having a frictional adhesion to the mitered frame corners 28, and capable of being clipped over the aligned corner joint after the frame is mounted. The corner clips enhance the appearance of the frame and add rigidity to the overall structure.

The extrusion method is the preferred method of producing the adjustable frame because of the economics of such construction. The frame is preferably made of metal or plastic with the outer and inner segments extruded to a close tolerance to give the frame rigidity as well as frictional cohesion between the telescoping parts.

While particular embodiments of the invention have been shown and described, it will be understood that the invention is not limited thereto, since modifications may be made and will become apparent to those skilled in the art. For example, the frame segments may be curved to accommodate rounded or oval displays or the frame may be constructed from a flexible material that would permit the user to create a frame of various shapes.

What is claimed is:

1. A frame section for covering at least a portion of the border of a wall-mounted display, comprising
- a plurality of nails for attaching the border of the display to the wall, each of said nails including
  - a first head on the driven end of said nail,
  - a second head axially displaced from said first head for holding the display border against the wall,
- resilient means located between said first and second heads and extending radially beyond said first head, and
- an elongate frame strip having an opening in the back thereof for passing over said first head and snapping over said resilient means by resilient action.
  - said resilient means contracting in size when said strip passes thereover and returning to its original size thereafter to hold strip strip against the border of the display.

2. A frame section in accordance with claim 1, wherein the surface of said strip not against the border of the display is concavedly curvilinear.

3. A frame section in accordance with claim 1, wherein said elongate frame strip includes telescoping pieces, each of said pieces having an opening in the back thereof for passing over said first head and snapping over said resilient means, said strip being held against the border of the display by resilient action.

4. A frame section in accordance with claim 1, wherein said opening in said strip is a slot.

5. A frame section in accordance with claim 1, wherein said resilient means comprises at least one tension spring wire affixed at one end near said first head and bowing outwardly therefrom.

6. A frame section in accordance with claim 1, wherein the edge or lips of the opening in the back of the frame are curved inward and backward.

7. A frame section in accordance with claim 1, wherein said strip is metal.

8. A frame section in accordance with claim 1, wherein said strip is plastic.

9. An adjustable frame for covering at least a portion of the border of a wall-mounted display, said frame including a plurality of sections having matingly conforming ends, each of said sections comprising
- a plurality of nails for attaching the border of the display to the wall, each of said nails including
  - a first head on the driven end of said nail,
  - a second head axially displaced from said first head for holding the display border against the wall,
- resilient means located between said first and second heads and extending radially beyond said first head, and
- an expansible elongate frame strip having an opening in the back thereof for passing over said first head and snapping over said resilient means, said resilient means contracting in size when said strip passes thereover and returning to its original size thereafter to hold said strip against the border of the display by resilient action.

10. An adjustable frame in accordance with claim 9, wherein the surface of said strip not against the border of the display is concavedly curvilinear.

11. An adjustable frame in accordance with claim 9, wherein each of said elongate frame strips includes telescoping pieces, each of said pieces having an opening in the back thereof for passing over said first head and snapping over said resilient means by resilient action, said strip being held against the border of the display.

12. An adjustable frame in accordance with claim 9, and including frame corner pieces connected over adjacent mating sections of said frame.

13. An adjustable frame in accordance with claim 9, wherein said opening in each of said elongate frame strips is a slot.

14. An adjustable frame in accordance with claim 9, wherein said resilient means comprises at least one tension spring wire affixed at one end near said first head and bowing outwardly therefrom.

15. A frame section in accordance with claim 9, wherein the edge or lips of the opening in the back of the frame are curved inward and backward.

16. An adjustable frame section in accordance with claim 9, wherein each of said elongate strips is metal.

17. An adjustable frame in accordance with claim 9, wherein each of said elongate strips is plastic.

* * * * *